US010208489B2

(12) United States Patent
Walens et al.

(10) Patent No.: US 10,208,489 B2
(45) Date of Patent: Feb. 19, 2019

(54) RAISED FLOORING SYSTEM AND ASSEMBLY METHOD WITH MAGNETICALLY-ATTACHED FLOORING SURFACE

(71) Applicant: EXPLORING, INC., Atlanta, GA (US)

(72) Inventors: David Walens, Atlanta, GA (US); Amy Vogel, Smyrna, GA (US); Matt Kelly, Acworth, GA (US); James Zacharias, Flowery Mount, TX (US); Geoffrey Wright, Marietta, GA (US)

(73) Assignee: EXPLORING, INC., Atlanta, GA (US)

( * ) Notice: Subject to any disclaimer, the term of this patent is extended or adjusted under 35 U.S.C. 154(b) by 0 days.

(21) Appl. No.: 15/349,187

(22) Filed: Nov. 11, 2016

(65) Prior Publication Data

US 2017/0058536 A1 Mar. 2, 2017

Related U.S. Application Data

(63) Continuation-in-part of application No. 15/082,339, filed on Mar. 28, 2016, now abandoned.

(60) Provisional application No. 62/140,058, filed on Mar. 30, 2015.

(51) Int. Cl.

| | |
|---|---|
| ***E04F 15/024*** | (2006.01) |
| ***E04F 15/02*** | (2006.01) |
| ***E04F 15/10*** | (2006.01) |
| ***F21V 33/00*** | (2006.01) |
| ***F21S 4/00*** | (2016.01) |
| *F21Y 115/10* | (2016.01) |

(52) U.S. Cl.

CPC .. *E04F 15/02447* (2013.01); *E04F 15/02005* (2013.01); *E04F 15/02144* (2013.01); *E04F 15/02194* (2013.01); *E04F 15/02405* (2013.01); *E04F 15/105* (2013.01); *F21S 4/00* (2013.01); *F21V 33/006* (2013.01); *E04F 2201/0517* (2013.01); *F21Y 2115/10* (2016.08)

(58) Field of Classification Search

CPC ..... E04F 15/02447; E04F 15/02144; E04F 15/02005; E04F 15/02194; E04F 15/105; E04F 15/02405; E04F 2201/0517; F21S 4/00; F21V 33/006; F21Y 2115/10

USPC ..... 52/177, 588.1, 589.1, 506.1, 403.1, 561, 52/582.2, 587.1, 458

See application file for complete search history.

(56) References Cited

U.S. PATENT DOCUMENTS 3,280,522 A * 10/1966 Palfey ..... E04B 1/6183 52/127.9
3,310,919 A * 3/1967 Bue ..... E01C 9/08 52/127.11
3,826,056 A * 7/1974 Smith ..... E04C 2/365 52/582.2
4,417,430 A * 11/1983 Loikitz ..... E04B 1/6183 292/111

(Continued)

*Primary Examiner* — Joshua K Ihezie
(74) *Attorney, Agent, or Firm* — Gardner Groff Greenwald & Villanueva, PC

(57) ABSTRACT

A system and method of removably attaching a flooring surface material to a subfloor. The subfloor may include a modular raised flooring system comprising a plurality of raised floor panels, and comprising a magnetic body, surface or underlayment material. The flooring surface material includes a magnetic attachment surface that holds the flooring surface material in place on the subfloor by magnetic attraction, but that allows removal for disassembly and/or replacement.

12 Claims, 6 Drawing Sheets

(56) References Cited

U.S. PATENT DOCUMENTS 4,831,806 A * 5/1989 Niese ..... E04F 15/18 52/391
4,996,818 A * 3/1991 Bettinger ..... E04F 15/02423 52/126.6
5,022,200 A * 6/1991 Wilson ..... E04F 15/02 52/127.9
5,205,091 A * 4/1993 Brown ..... E04F 15/024 52/126.6
5,271,200 A * 12/1993 Witt ..... A47G 27/0475 52/385
6,093,469 A * 7/2000 Callas ..... A47L 23/266 15/217
6,128,881 A * 10/2000 Bue ..... E04F 15/02 52/177
6,189,283 B1 * 2/2001 Bentley ..... E04F 15/02 52/457
6,966,155 B2 * 11/2005 Nevison ..... E04F 15/105 15/238
7,546,707 B1 * 6/2009 DiGennaro ..... E04F 15/082 404/34
7,690,160 B2 * 4/2010 Moller, Jr. ..... E04F 15/10 404/35
7,841,151 B2 * 11/2010 Uhlig ..... A47G 27/0431 428/60
8,205,407 B2 * 6/2012 Genova ..... E04B 5/026 403/335
2002/0108323 A1 * 8/2002 Gruber ..... A47G 27/0237 52/177
2003/0221388 A1 * 12/2003 Benedettini ..... E04F 19/061 52/716.1
2006/0130378 A1 * 6/2006 Rybalov ..... G09F 19/22 40/546
2006/0150565 A1 * 7/2006 Schacht ..... E04F 15/02005 52/716.1
2006/0191218 A1 * 8/2006 Pacione ..... A47G 27/0243 52/234
2007/0113492 A1 * 5/2007 Dickey ..... E04F 15/02 52/177
2007/0204428 A1 * 9/2007 Pacione ..... A47G 27/025 16/4
2011/0265409 A1 * 11/2011 Pien ..... E04B 5/026 52/309.1
2012/0000156 A1 * 1/2012 Esposito ..... E04F 15/02144 52/309.13
2013/0291474 A1 * 11/2013 Tillery ..... E04F 15/02 52/588.1
2014/0245692 A1 * 9/2014 Bowers ..... E04F 15/02038 52/582.2
2014/0283468 A1 * 9/2014 Weitzer ..... E04F 11/108 52/177
2015/0191918 A1 * 7/2015 Atkinson ..... E04F 15/107 428/205
2015/0225946 A1 * 8/2015 Dickey ..... B32B 37/144 52/309.5
2016/0007787 A1 * 1/2016 Johnson ..... A47G 27/0231 428/58
2016/0289962 A1 * 10/2016 Crow ..... E04B 5/46
2016/0319553 A1 11/2016 Lautzenhiser et al.
2016/0375673 A1 12/2016 Lautzenhiser et al.

* cited by examiner

RAISED FLOORING SYSTEM AND ASSEMBLY METHOD WITH MAGNETICALLY-ATTACHED FLOORING SURFACE

CROSS-REFERENCE TO RELATED APPLICATION

This application is a continuation-in-part of U.S. Non-Provisional patent application Ser. No. 15/082,339 filed Mar. 28, 2016, which claims the priority benefit of U.S. Provisional Patent Application Ser. No. 62/140,058 filed Mar. 30, 2015, which are hereby incorporated herein by reference.

TECHNICAL FIELD

The present invention relates generally to the field of flooring systems, and more particularly to a raised flooring system having interchangeable decorative flooring surface panels magnetically and removably attached to a modular raised floor base or subflooring system, and to assembly methods for such flooring systems.

BACKGROUND

Raised flooring systems are used in various applications, including without limitation in trade show exhibits and event space areas. Additionally, decorative or utilitarian flooring surface materials are commonly applied to subflooring or underlayment systems in commercial, residential and industrial structures.

In some applications, it has been found desirable to provide portable and reusable flooring systems with an interchangeable and/or reusable decorative flooring surface. In other applications, it has been found desirable to provide interchangeable decorative flooring surface treatments to a subflooring or floor underlayment system.

Accordingly, it can be seen that needs exist for improved flooring systems. It is to the provision of an improved flooring system meeting these and other needs that the present invention is primarily directed.

SUMMARY

In example embodiments, the present invention provides a portable and reusable raised flooring system with interchangeable decorative flooring surface panels magnetically and removably attached to a modular raised floor base or subflooring system. In example embodiments, the flooring system of the present invention may be particularly adapted for use in trade show exhibit and event space applications, but is also adaptable for use in various other applications.

In one aspect, the present invention relates to a flooring system preferably including a subfloor assembly, a magnetic subfloor layer attached to the subfloor assembly, and a magnetic finished floor layer removably attached to the magnetic subfloor layer.

In another aspect, the invention relates to a flooring system including a modular raised subfloor assembly including a plurality of raised floor panels and couplings to releasably attach the raised floor panels to one another, a magnetic subfloor layer attached to the modular raised subfloor assembly, and a magnetic finished floor layer removably attached to the magnetic subfloor layer.

In another aspect, the invention relates to a flooring system including a modular raised subfloor assembly including a plurality of raised floor panels and couplings to releasably attach the raised floor panels to one another, a finished floor layer for attachment over the modular raised subfloor assembly, and a recessed lighting strip extending along at least a portion of the finished floor layer.

In another aspect, the invention relates to a method of applying a flooring material to a subfloor structure. The method preferably includes applying a magnetic subfloor layer to the subfloor structure, and removably attaching a magnetic finished floor material to the magnetic subfloor layer.

In still another aspect, the invention relates to a magnetic subfloor component and/or a magnetic finished floor material component adapted for use in such systems or methods.

In another aspect, the invention relates to a magnetic flooring underlayment comprising a padding layer and a magnetic layer.

In another aspect, the invention relates to a magnetic finished floor material component adapted for use in the system or method described or claimed herein.

In another aspect, the invention relates to a magnetic flooring underlayment comprising a padding layer and a magnetic layer.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 3:
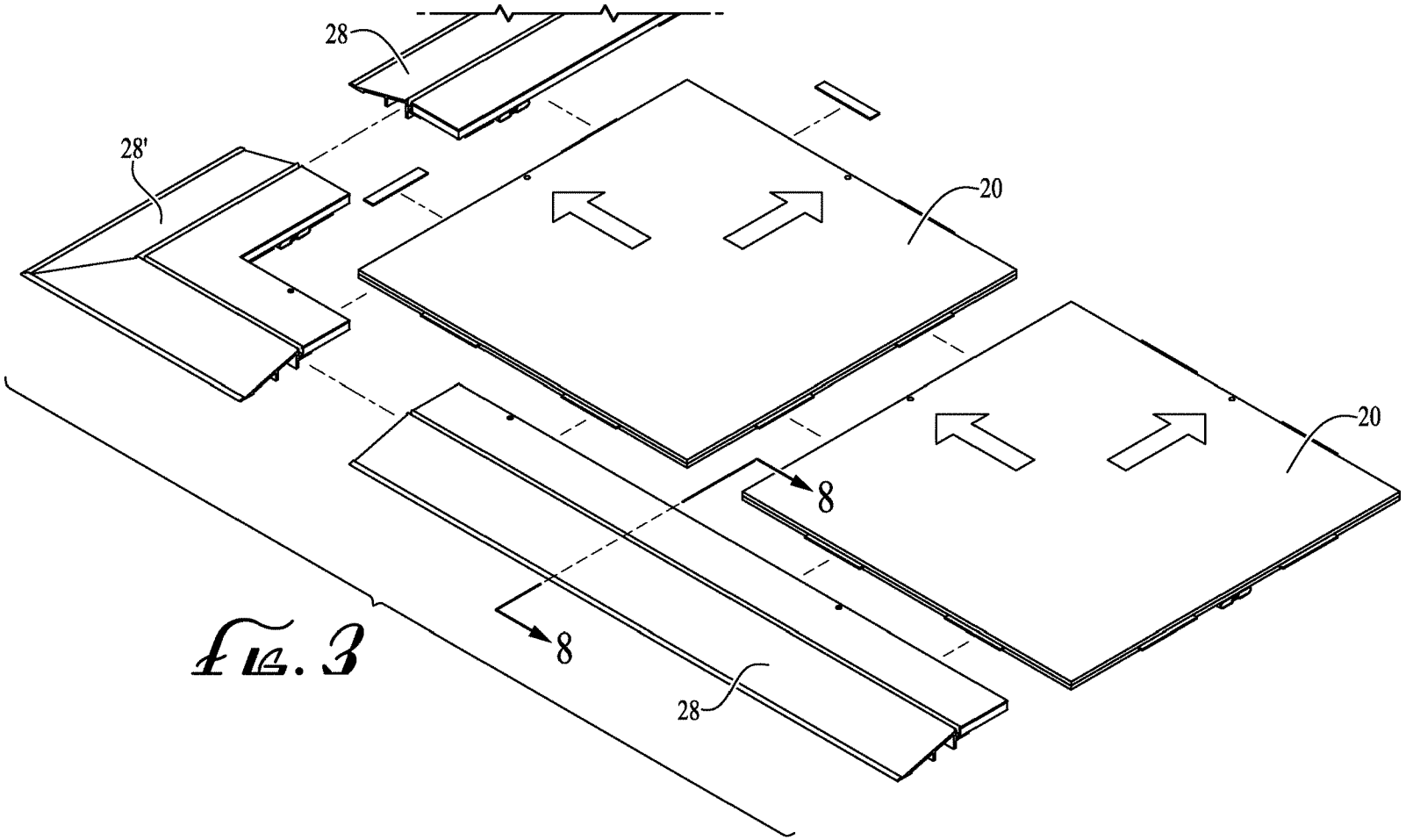
FIG. 3 shows a detailed perspective assembly view of floor panel and edge panel portions of a flooring system according to an example form of the present invention.
Figure 4:
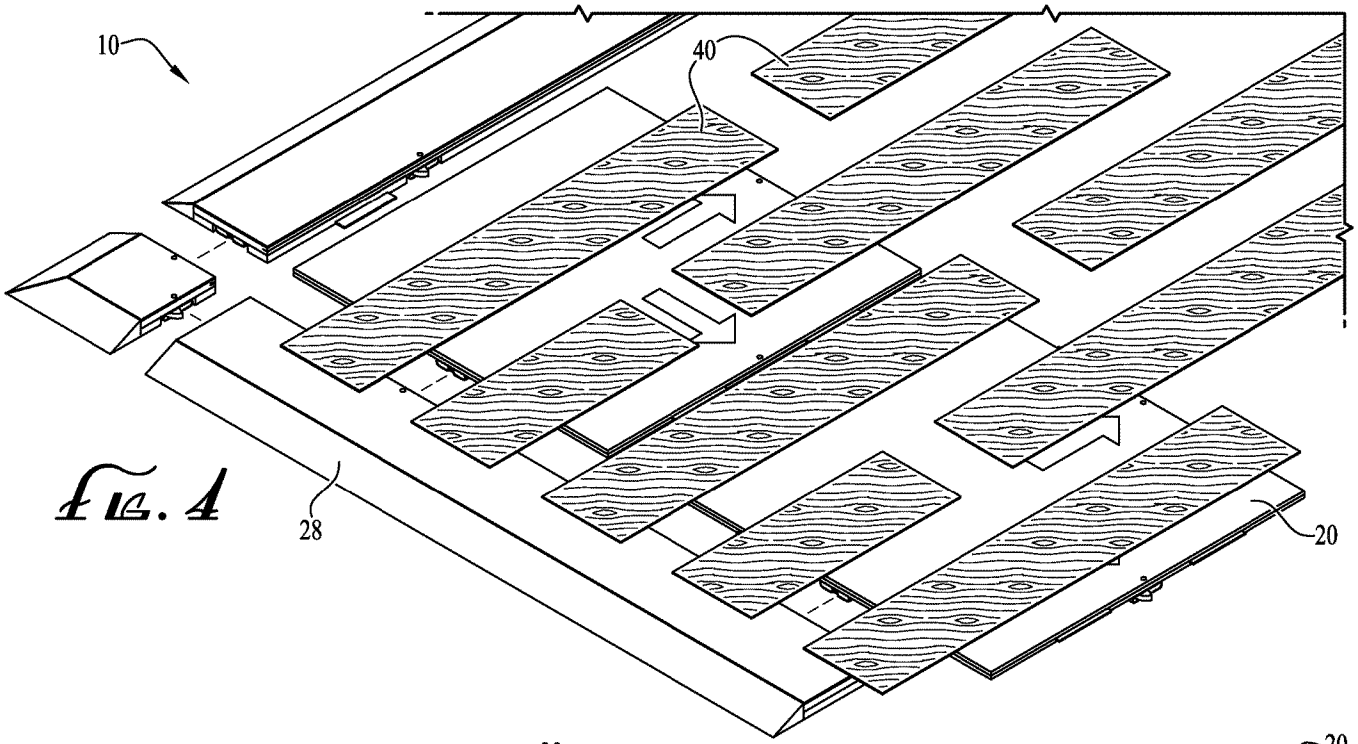
FIG. 4 shows a detailed perspective assembly view of floor panel, edge panel, and magnetic finished floor layer portions of a flooring system according to another example form of the present invention.
Figure 5:
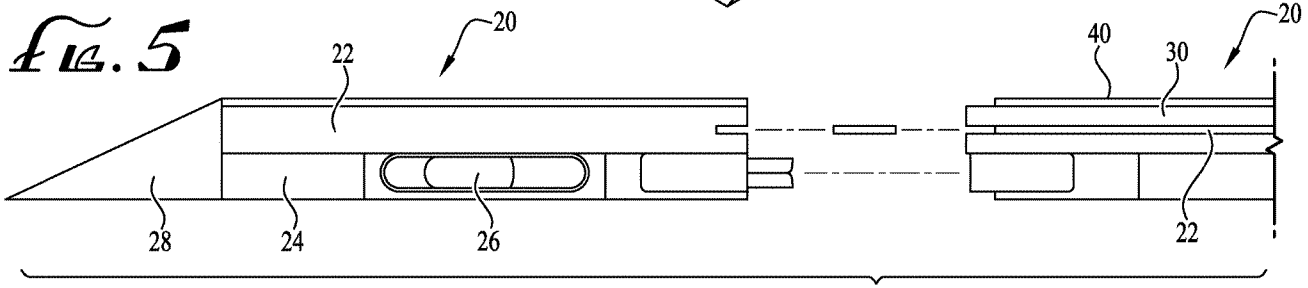
FIG. 5 shows a detailed cross-sectional side view of an edge transition portion, and alignment and coupling features of a flooring system according to an example form of the present invention.

With reference now to the drawing figures, wherein like reference numbers represent corresponding parts throughout the several views, FIGS. 1-7 show example embodiments, features and advantages of a flooring system 10 according to example forms of the present invention, and example assembly methods and advantages of use of a flooring system 10 according an example form of the present invention. The flooring system 10 generally comprises a modular raised flooring system comprising a plurality of raised floor panels 20, a magnetic subfloor layer 30, and a magnetic finished floor layer 40. The raised floor panels may comprise, for example, 3'×3' square panels incorporating plywood structural panels 22 with support feet 24 and under-mount cam lock connections 26 or other couplings for joining adjacent panels into a consolidated array as shown in FIGS. 1-4. Optionally, inclined or ramped edge strips 28 and corner strips 28' are provided along one or more sides of the flooring panel array to provide a gradual transition from the underlying support surface to the raised floor level, as shown in FIGS. 3-5. Spline and dado alignment features are optionally provided along confronting edges of adjacent panels 20 for leveling alignment during assembly, as shown in FIG. 5. The structural panel construction of the Altitude R&R™ raised flooring system of exploring, Inc., d/b/a Brumark (see http://brumark.com/Products/41/altitude-r-r) is incorporated herein by reference.

In example embodiments, the floor panels 20 are fabricated from plywood, injection molded plastic, medium density fiberboard (MDF), expanded polyvinyl chloride (PVC) (Sintra) board, marine plywood, Class A fire-proof MDA, acrylic, plexiglass, steel, aluminum, other metals, honeycomb cells, and/or other substantially rigid structural materials. In alternate embodiments, the floor panels comprise one or more 4'×8' sheets of plywood screwed together as a puck floor, or various other panel size, material and configuration(s). In example embodiments, the support feet 24 are attached, for example by stapling, adhesive, screws, nails or other attachment means, to the underside or bottom face of the floor panel 20, at one or more locations configured to provide even structural support and stability to the floor panels when assembled into the desired floor system configuration. In the example embodiment shown in FIG. 6, five support feet 24 are provided, four at the corners of the floor panel 20, and one at the center of the floor panel.

Figure 6:
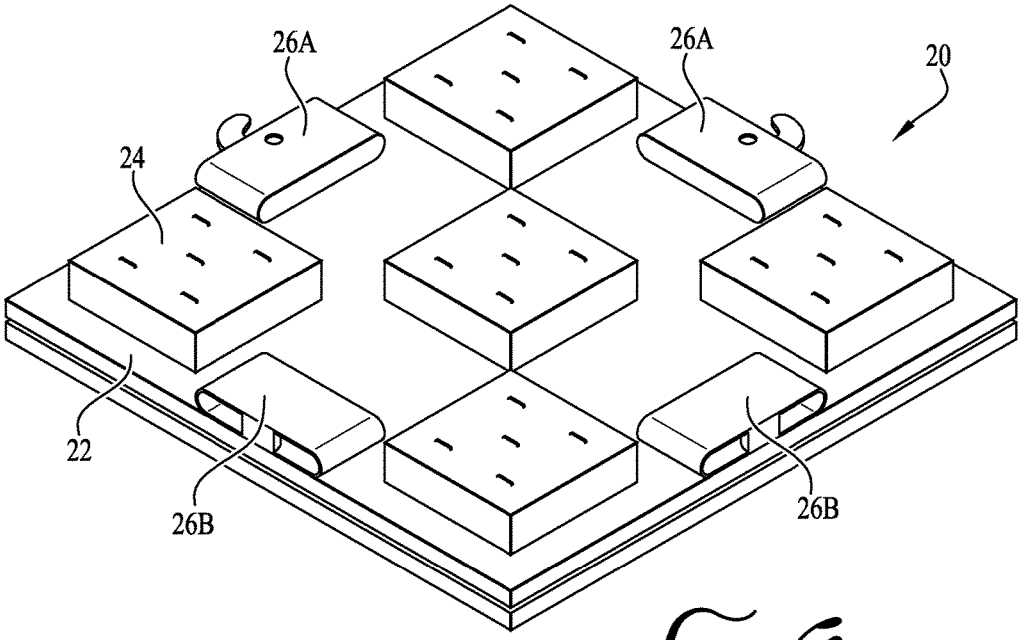
FIG. 6 shows a perspective view of the bottom side and support members and coupling elements of a flooring panel component of a flooring system according an example form of the present invention.
Figure 7:
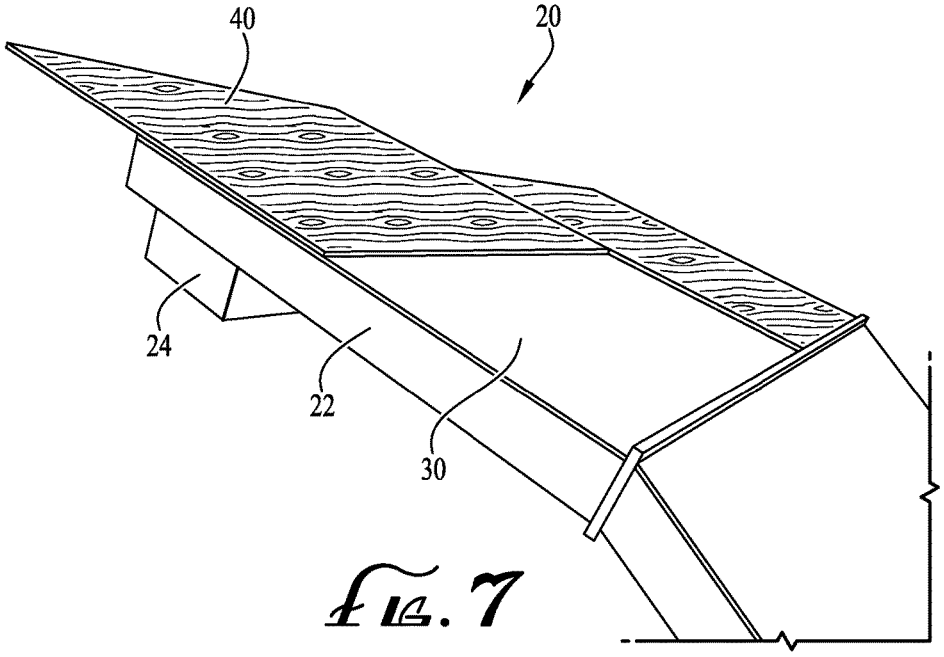
FIG. 7 is a side assembly view of a flooring panel component of a flooring system according an example form of the present invention.

In example embodiments, the connectors or couplings 26 comprise roto-lock rotary draw catch couplings (coffin locks) comprising cooperating pairs of first (male) coupling components 26A configured to releasably engage and disengage with a corresponding second (female) coupling component 26B. As shown in FIG. 6, two first coupling components 26A are mounted to each floor panel 20 centered along adjacent first and second sides on the underside of the floor panel, and two second coupling components 26B are mounted to the floor panel centered along adjacent third and fourth sides one the underside of the floor panel. In this manner, both of the first coupling components 26A are opposite and oriented about 180° relative to a second coupling component 26B, the first coupling components 26A are oriented about 90° relative to one another, and the second coupling components 26B oriented about 90° relative to one another. This allows multiple floor panels 20 to be assembled in an array (see FIG. 2), and the first coupling components 26A of each floor panel engaged with second coupling components 26B of adjacent floor panels to couple the floor panels together in a linked array forming the desired shape and size of the overall flooring system 10. In example embodiments, an Allen wrench or key is inserted from the upper side of the floor panels 20 through holes extending through the thickness of the floor panels in alignment with actuator elements of the first coupling components 26A, to engage and disengage the first coupling components of one panel with second coupling components 26B of adjacent floor panels. In example embodiments, one or more individual panels can be separately disengaged and removed from the assembled array of the floor system 10, for example for electrical access underneath the floor, for replacement, or reconfiguration. Similarly configured coupling elements 26A and/or 26B can be provided on the edge strips 28 to releasably attach the edge strips to adjacent floor panels 20.

In example embodiments, the magnetic subfloor layer 30 is permanently or semi-permanently attached to the top surface of the raised floor panels 20, for example by adhesive, screws, staples or other attachment means. Alternatively, the magnetic subfloor layer 30 is embedded within or forms an integral part of the panels 20, or may be applied over the floor panels but not positively attached or affixed thereto. In still further alternate forms, the magnetic subfloor layer 30 comprises a ferrous paint or coating, such as for example a magnetic primer or paint, applied onto the upper surfaces of the floor panels 20. The magnetic subfloor layer 30 may comprise a magnetic material such as a permanent magnet, or can comprise a magnetically attracted material such as an iron-containing material that is not itself magnetic. In example embodiments, the magnetic subfloor layer 30 overlies all or a substantial portion of the surface area of the raised floor panels 20. In alternate embodiments, the magnetic subfloor layer 30 is positioned in strips or regularly spaced locations along the surface of the raised floor panels 20.

The magnetic finished floor layer 40 comprises a decorative flooring surface layer along a top face thereof, and a magnetic layer along a bottom face. In example forms, the decorative flooring surface layer comprises a luxury vinyl tile (LVT) surface, a laminate, a wood, composite, roll goods, carpet, fabric, or other flooring surface material. In example embodiments, the decorative flooring surface layer of the magnetic finished floor layer 40 has a wood-grain pattern presenting the visual appearance of finished natural wood flooring or other aesthetically appealing appearance. The magnetic finished floor layer 40 preferably comprises a plurality of tiles, strips or panels of regular uniform width, thickness, and/or lengths, such as square or rectangular tiles or panels. The magnetic subfloor layer 30 may comprise a magnetic material forming a permanent magnet, or can comprise a magnetically attracted material such as an iron-containing or ferrous material that is not itself magnetic. In example embodiments, one of the magnetic subfloor layer 30 or the magnetic finished floor layer 40 comprises a magnetic material such as permanent magnet magnetic sheet goods and the other comprises a magnetically attracted ferrous (non-magnet) material. In alternate embodiments, the magnetic subfloor layer 30 and the magnetic finished floor layer 40 both comprise permanent magnet magnetic materials, with opposite magnetic polarities (+/−) facing one another when assembled. Thus, as used herein, "magnetic" may refer to either a magnetically-attractive or magnetized material such as a permanent magnet that imparts magnetic attraction on non-magnetic but magnetically-attracted (e.g., ferrous) materials, or to a non-magnetic but magnetically-attracted (e.g., ferrous) material.

In use, two or more raised floor panels 20 are transported to the desired location and assembled in a multi-panel array, for example having a square or rectangular floor system configuration, to form a raised subfloor system with the magnetic subfloor layer 30 facing upwardly. The magnetic finished floor layer 40 is placed onto the raised subfloor system and aligned into the desired orientation, to substantially cover the magnetic subfloor layer 30. The magnetic finished floor layer 40 is removably and repositionably held in place by magnetic attraction between the magnetic subfloor layer 30 and the magnetic finished floor layer. The magnetic finished floor layer 40 preferably defines an aesthetically attractive, continuous and smooth flooring surface over all or a substantial portion of the flooring system 10.

After use, the flooring system 10 can be disassembled by removing the magnetic finished floor layer 40 from the magnetic subfloor layer 30 by pulling and separating to overcome the magnetic attraction therebetween. The floor panels 20 can be disassembled for transport, storage and reuse, and/or another magnetic finished floor layer 40 can be replaced over the magnetic subfloor layer 30, for example to replace all or a portion of a worn or damaged flooring surface or to provide a different decorative appearance.

Figure 1:
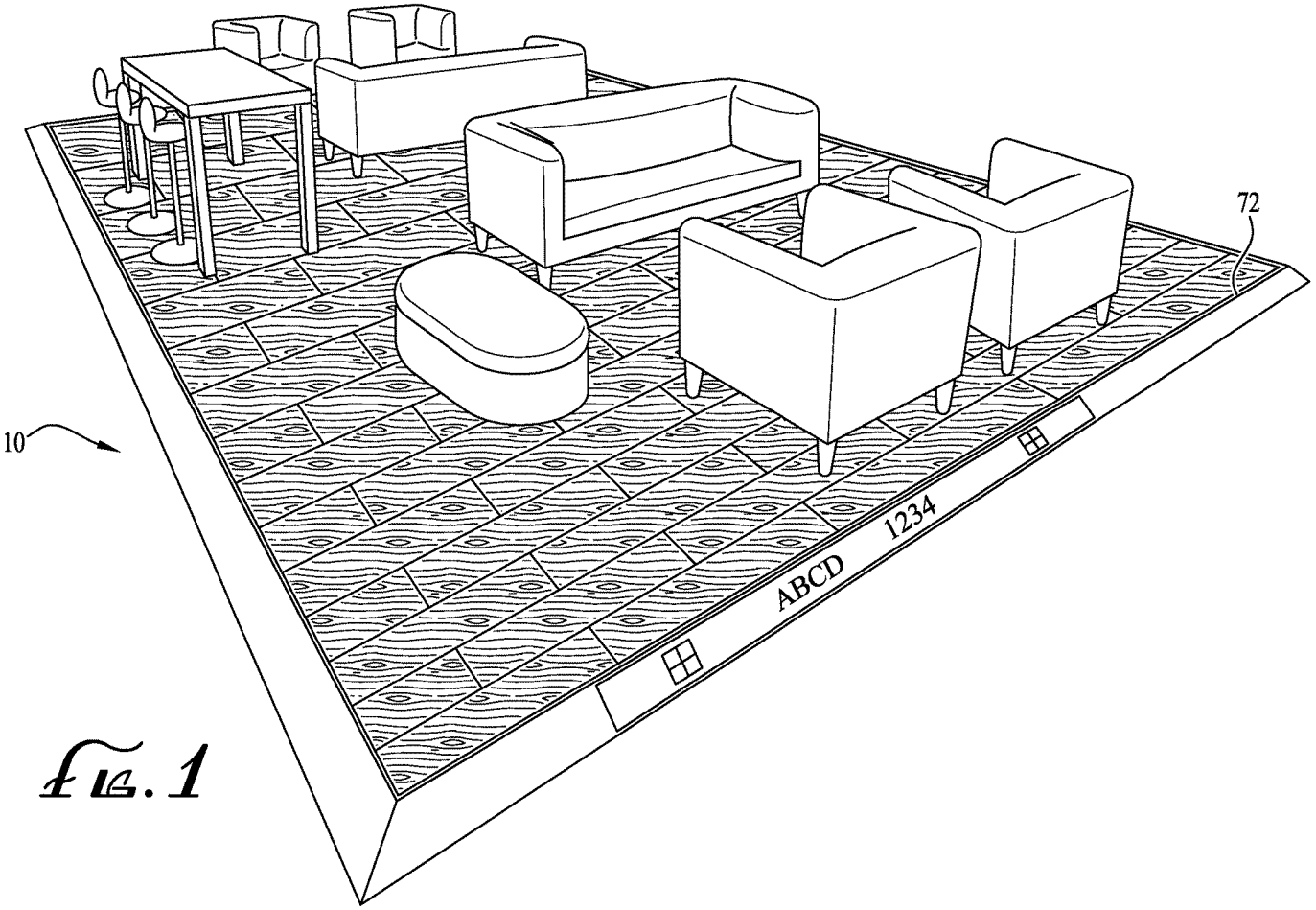
FIG. 1 shows a perspective view of a flooring system according to an example form of the present invention.
Figure 2:
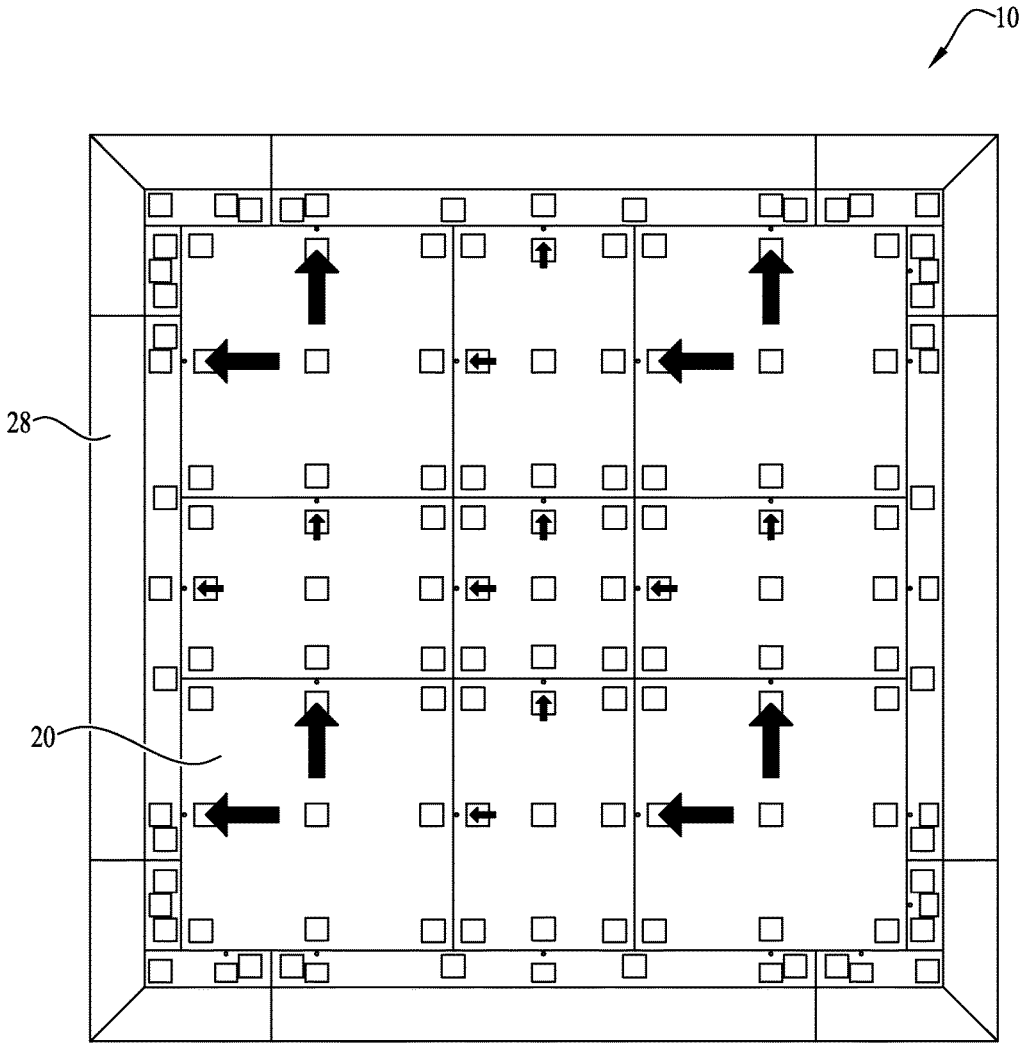
FIG. 2 shows a schematic plan view of support members and coupling elements for assembly of a flooring system according to an example form of the present invention.
Figure 8:
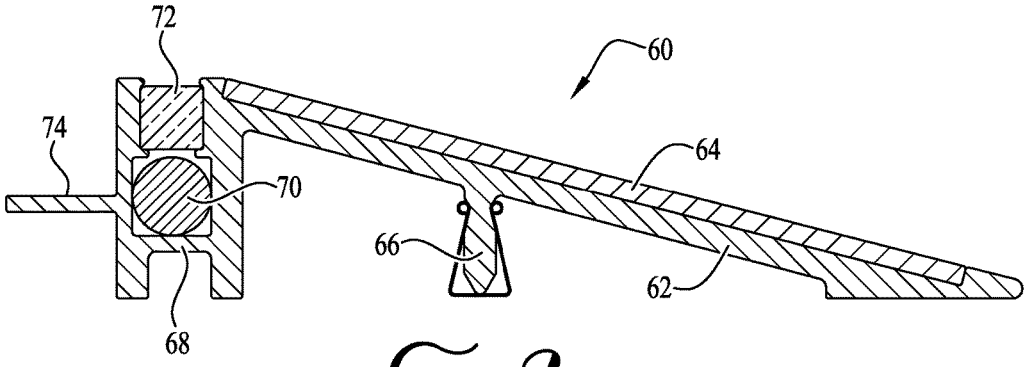
FIG. 8 is a detailed side cross-sectional view of an edge transition portion of the flooring system according to another example form of the present invention.

FIG. 8 shows an edge transition component 60 according to another example embodiment of the invention. The edge transition component 60 is configured for attachment around the outer perimeter of the assembled array of flooring panels 20, to provide a smooth transition between the underlying floor or other support surface and the raised finished flooring surface 40 of the floor system 10, for example to provide improved access onto the floor, to prevent tripping, and/or for a more finished aesthetic appearance. The edge transition component 60 can be fabricated as an extrusion, by molding, machining, milling or otherwise, of aluminum, steel or other metals, plastic, wood, composites, and/or other material(s) of construction, and can be an integrally formed unitary component, or can be an assembly of two or more subcomponents. The edge transition component 60 comprises an inclined upper panel 62 having a proximal end or toe end configured for resting upon the underlying floor or support surface. The upper panel 62 optionally defines a recessed portion along its upper face for receiving a strip of finished flooring material or other surface material 64. In example embodiments, graphics, text or other information may be applied to the surface material 64 to present marketing, promotional or other information along the edge of the flooring system, for example as shown in FIG. 1. In alternate embodiments, the surface material 64 matches the appearance of the finished flooring surface 40 of the floor system 10, or provides a desired contrasting appearance with the finished flooring surface, for example allowing for the provision of a multi-colored and/or multi-patterned appearance of the flooring system for aesthetic, branding or other purposes. The surface material 64 can be magnetically attached to the upper panel 62 as described above, or attached by adhesive or otherwise. One or more intermediate support strut(s) 66 and a distal end support 68 extend downward from the upper panel for engagement with the underlying floor or support surface. One or more spring clips are optionally provided for engagement with the intermediate support strut, for stabilization, and/or to align adjacent edge transition components 60 and reduce gaps therebetween. An engagement flange 74 is optionally provided extending generally horizontally from the distal side of the edge transition component 60, for engagement with the outer periphery of the floor panels 20 of the flooring system 10.

Optionally, a recess or channel is provided in the upper face of the edge transition component 60 for receiving decorative elements such as a lighting and/or color strip. For example, an LED (light emitting diode) light strip 70 and/or a color/diffuser strip 72 is/are optionally installed in the recess or channel of the edge transition component 60. In the depicted embodiment, an LED light strip 70 is positioned below a diffuser strip 72, so that light from the LED strip is blended and diffused as it passes through the diffuser strip, generating a lighted outline around at least a portion of the perimeter of the floor system 10. The diffuser strip may be a clear, translucent white, or other color, for example to generate attention, or for corporate branding (company colors) purposes. In alternate embodiments, the LED strip may be omitted, and only a color strip 72 provided around some or all of the perimeter of the flooring system 10. The color strip 72 can be, for example, a plexiglass, plastic, chrome or other material, of any color, texture, pattern or appearance, and can be transparent, translucent or opaque. In example embodiments, the color/diffuser strip 72 is between about 0.25" to about 1", for example about ½" (0.5") wide, but in alternate embodiments can be thicker or thinner as necessary to produce a desired appearance.

In further example embodiments, the flooring system 10 comprises additional lighting components in connection with an LED lighting strip 70 or other lighting features. For example, a power supply or transformer such as a 12 volt, 96 watt, plug-in power supply, and an LED controller and receiver are provided in electrical contact with one or more 12 volt RGB LED tape lighting strip(s) positioned in or on the lighting system, for example recessed in an edge transition component 60 as described above. Optionally, one or more of the lighting components is mounted or positioned under the flooring panels 20. Optionally, other wiring, power conduits, communication cables, computer network equipment, security equipment, or the like are also mounted or positioned under the flooring panels 20.

Figure 9:
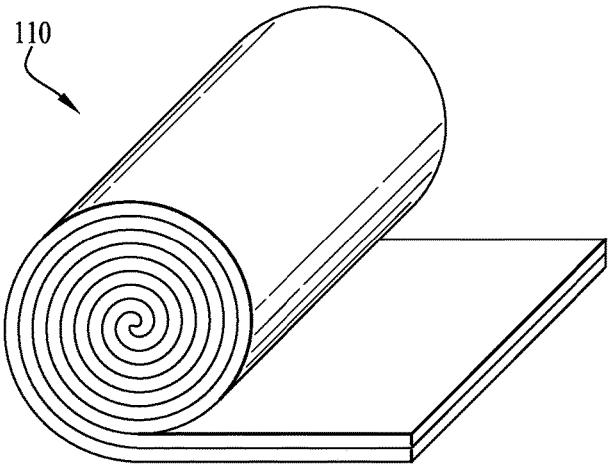
FIG. 9 shows a roll of magnetic flooring underlayment according to an example embodiment of the invention.
Figure 10:
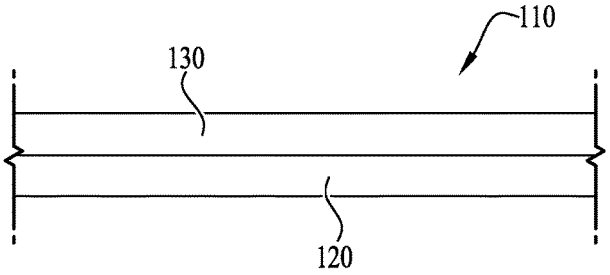
FIG. 10 shows a detailed side edge view of the magnetic flooring underlayment of FIG. 9, according to an example embodiment of the invention.

In example forms, the subfloor assembly 30 comprises a modular and portable flooring system such as for use in trade show exhibit and event space applications, and/or other temporary use structures. In alternate forms, the subfloor assembly may comprise a more permanent structure, such as for example a standard residential or commercial subfloor. For example, a magnetic underlayment material may be applied to a framed (e.g., joist-and-plywood), concrete, steel or other type of subfloor structure, and a magnetic finished floor layer 40 installed over the subfloor for temporary or permanent use. For example, FIGS. 9 and 10 show a roll of flexible magnetic flooring underlayment 110, and a detailed sectional view of an underlayment material according to example forms of the invention. The underlayment 110 comprises a padding layer 120 comprising for example an LVT underlayment material formed of an ethylene/vinyl acetate copolymer, for example as marketed by Manning & Co., LLC of Pinehurst N.C. under the trade name Wunderlayment™, laminated or otherwise affixed to a magnetic or flexible iron (ferrous) layer 130 formed of a ferrite and chlorinated polyethylene, for example as marketed by Sanders Group of The Netherlands under the trade name Flexmetal™ Strip & Sheet. In example forms, the flexible magnetic flooring underlayment 110 can comprise sheets, panels, rolls or other formats, for example having a width of 1', 2', 3', 4', 5', 6', 8', 10', 12', 14', 16', 18', 20', or greater or lesser widths, and a length of 1' to 100', or greater or lesser lengths, and may be rectangular, square, circular, or other shape(s) adapted to the intended application. The flexible magnetic flooring underlayment 110 can be configured to be cut to fit, or can be manufactured to specified dimensions. Optionally, an adhesive may be pre-applied to the underside of the flexible magnetic flooring underlayment 110 for attachment to a subfloor.

While the invention has been described with reference to preferred and example embodiments, it will be understood by those skilled in the art that a variety of modifications, additions and deletions are within the scope of the invention, as defined by the following claims.

What is claimed is:

1. A flooring system comprising:

a subfloor assembly comprising a plurality of modular subfloor panels each comprising couplings for releasably coupling adjacent modular subfloor panels to one another to form a multi-panel coupled array, and further comprising a magnetic subfloor layer extending substantially across the multi-panel coupled array, wherein the magnetic subfloor layer is not affixed to the multi-panel coupled array; and a magnetic finished floor layer configured for removable magnetic attachment to the magnetic subfloor layer, the magnetic finished floor layer comprising a plurality of magnetic finished floor panels, at least one of the plurality of magnetic finished floor panels extends over multiple modular subfloor panels, wherein the magnetic finished floor layer can be applied to and removed from the subfloor assembly without disassembling the modular subfloor panels of the multi-panel coupled array from one another, and wherein the magnetic attachment between the magnetic subfloor layer and the magnetic finished floor layer is the only attachment holding the magnetic finished floor layer to the flooring system.

2. The flooring system of claim 1, wherein the couplings comprise rotary draw catch couplings.

3. The flooring system of claim 1, wherein the finished floor layer comprises a vinyl flooring material.

4. The flooring system of claim 1, further comprising edge transition elements for positioning around at least a portion of a periphery of the subfloor assembly.

5. The flooring system of claim 4, wherein the edge transition elements comprise an inclined transition surface.

6. The flooring system of claim 4, wherein the edge transition elements comprise recessed lighting strips.

7. The flooring system of claim 4, wherein the edge transition elements comprise recessed color strips.

8. The flooring system of claim 4, wherein the edge transition elements comprise a surface material having an appearance configured to complement the finished floor layer.

9. A flooring system comprising:

a modular raised subfloor assembly comprising a plurality of raised subfloor panels each comprising couplings to releasably attach the raised subfloor panels to one another to form a multi-panel coupled array, and further comprising a magnetic subfloor layer extending substantially over but not affixed to the multi-panel coupled array;

a magnetic finished floor layer for magnetic attachment directly to the magnetic subfloor layer over the modular raised subfloor assembly, the magnetic finished floor layer comprising a plurality of magnetic finished floor panels, at least one of the plurality of magnetic finished floor panels extends over multiple raised subfloor panels of the multi-panel coupled array, wherein the plurality of magnetic finished floor panels do not directly engage a raised subfloor panel, and wherein the magnetic finished floor layer can be applied to and removed from the subfloor assembly without disassembling the raised subfloor panels of the multi-panel coupled array from one another; and a recessed lighting strip extending along at least a portion of the finished floor layer.

10. The flooring system of claim 9, further comprising an edge transition component configured for attachment around at least a portion of a periphery of the modular raised subfloor assembly, and wherein the lighting strip is recessed in the edge transition component.

11. The flooring system of claim 10, further comprising a diffuser strip over the recessed lighting strip.

12. A method of installing a flooring system, the method comprising:

assembling a subfloor assembly comprising a plurality of modular subfloor panels and releasably coupling the modular subfloor panels to one another to form a multi-panel coupled array, the subfloor assembly further comprising a magnetic subfloor layer that is placed on top of the array of modular subfloor panels from above, wherein the magnetic subfloor layer is not attached to the array of modular subfloor panels; and removably attaching a magnetic finished floor material to the magnetic subfloor layer of the subfloor assembly, the magnetic finished floor material comprising a plurality of magnetic finished floor panels, wherein at least one of the plurality of magnetic finished floor panels is attached over multiple modular subfloor panels, and wherein the magnetic finished floor material is attached to and removed from the subfloor assembly without disassembling the modular subfloor panels of the multi-panel coupled array from one another.

* * * * *